United States Patent [19]

Horwinski

[11] 4,000,405

[45] Dec. 28, 1976

[54] ELECTRICAL ADAPTOR AND NIGHT LIGHT

[75] Inventor: Elwood R. Horwinski, Cheshire, Conn.

[73] Assignee: Product Concepts, Inc., Middlebury, Conn.

[22] Filed: Aug. 28, 1975

[21] Appl. No.: 608,746

[52] U.S. Cl. ..... 240/2 SP; 240/52.1; 240/73 QD

[51] Int. Cl.[2] ..... F21V 33/00

[58] Field of Search ..... 240/2 SP, 52.1, 73 QD; 307/146; 317/101; 315/207

[56] References Cited

UNITED STATES PATENTS

| | | | |
|---|---|---|---|
| 2,749,428 | 6/1956 | McCarthy | 240/2 SP |
| 2,863,038 | 12/1958 | Lombardo | 240/73 QD |
| 2,896,125 | 7/1959 | Morton | 315/272 |
| 2,981,866 | 4/1961 | Tsien | 315/240 |
| 3,061,716 | 10/1962 | Benander | 240/73 QD |
| 3,173,031 | 3/1965 | Slater | 307/146 |
| 3,218,511 | 11/1965 | Rosenbaum | 315/207 |
| 3,256,466 | 6/1966 | Trolio et al. | 317/101 |
| 3,739,226 | 6/1973 | Seiter | 240/2 SP |

*Primary Examiner*—L. T. Hix
*Assistant Examiner*—Alan Mathews
*Attorney, Agent, or Firm*—H. Gibner Lehmann; K. Gibner Lehmann

[57] ABSTRACT

A combined electrical receptacle type adaptor and night light providing both multiple electrical sockets and subdued illumination, comprising a wall plate in the form of a truncated pyramid with four sloped faces and a pair of conductor prongs protruding from the rear of the wall plate and adapted to be received in openings of an existing wall outlet for establishing electrical contact with the circuits thereof. The wall plate carries a pair of two-conductor sockets, the conductors of which are connected respectively to the back prongs. The plate additionally has a pair of electric lamps respectively disposed at non-adjacent faces of the pyramid, for illuminating areas on opposite sides thereof. Also carried by the wall plate is a switch connected with the lamps, providing control of their energization. In a preferred embodiment, the switch is disposed in a third face of the pyramid and enables the lamps to be selectively energized at either half or full brilliance. The arrangement is such that the adaptor can be readily installed over the existing wall outlet, to provide subdued illumination without sacrifice or loss of the duplex function of the outlet.

2 Claims, 6 Drawing Figures

ELECTRICAL ADAPTOR AND NIGHT LIGHT

BACKGROUND

This invention relates generally to electrical adaptors, and more particularly to receptacle type adaptors intended to be used with existing wall outlets.

In the past a number of different night light arrangements for installation in existing wall outlets have been proposed and produced. Typically, night lights have been manufactured in the form of a small plug which carried an electric lamp, the plug being adapted to be inserted in one of the outlets of a standard duplex wall receptacle. While such devices operated satisfactorily, their use represented the loss of one wall outlet which was often needed for other appliances, lights, etc. In an effort to overcome this, a device known as a "cube tap" has frequently been used in one outlet of a duplex wall receptacle, with the night light in turn being inserted in one of the sockets of the cube tap. Such an arrangement enabled the accommodation of multiple additional plugs while still maintaining the night light capability. However, the use of cube taps has been found to be somewhat undesirable, in that they are easily jarred loose from the wall receptacle, tend to be rather bulky, particularly when carrying a night light device, and invariably work loose and result in poor connections. In many cases the operator is required to jiggle the assemblage in order to establish satisfactory electrical contact between the various parts. In addition, such arrangements were not particularly pleasing to the eye, and thus were not suitable for use in homes or offices requiring a neat or finished appearance.

SUMMARY

The above disadvantages and drawbacks of prior night light devices are obviated by the present invention, which has for an object the provision of a novel and improved electrical receptacle type adaptor providing also a night light, which is simple in construction, reliable in operation, and which provides an extremely neat and finished appearance, thus enabling its use in homes or offices requiring a finished look. Still another object of the invention is the provision of an electrical receptacle type adaptor as above, which provides a desirable subdued illumination without sacrifice or loss of the duplex function of the existing wall fixture. Yet another object of the invention is the provision of an adaptor as above characterized, wherein the degree of illumination can be controlled and also completely eliminated, all without resorting to removal of the adaptor or substitution of parts therein.

The above objects are accomplished by a combined electrical receptacle type adaptor and night light providing, from a standard duplex wall fixture, subdued illumination and multiple circuits to accommodate a series of electrical plugs, the adaptor comprising a wall plate having the form of a truncated pyramid with four faces, a pair of conductor prongs protruding from the rear of the wall plate for insertion into openings of the wall outlet for establishing electrical contact with the circuits thereof, a pair of two conductor sockets in the wall plate, at least one window or opening in a face of the pyramid together with a lamp disposed at the window such that light therefrom can pass therethrough, and optionally a switch carried by the wall plate and connected to the lamp so as to control the energization thereof. The wall plate includes a plateau in which the sockets are disposed, the switch being carried in another of the faces of the pyramid. The plate is adapted to overlie the wall fixture, with the conductor prongs being received in the existing outlet openings. The arrangement is such that the adaptor provides a soft illumination without sacrifice of the duplex function of the outlet.

Other features and advantages will hereinafter appear.

In the drawings, illustration a preferred embodiment of the invention:

Figure 1:
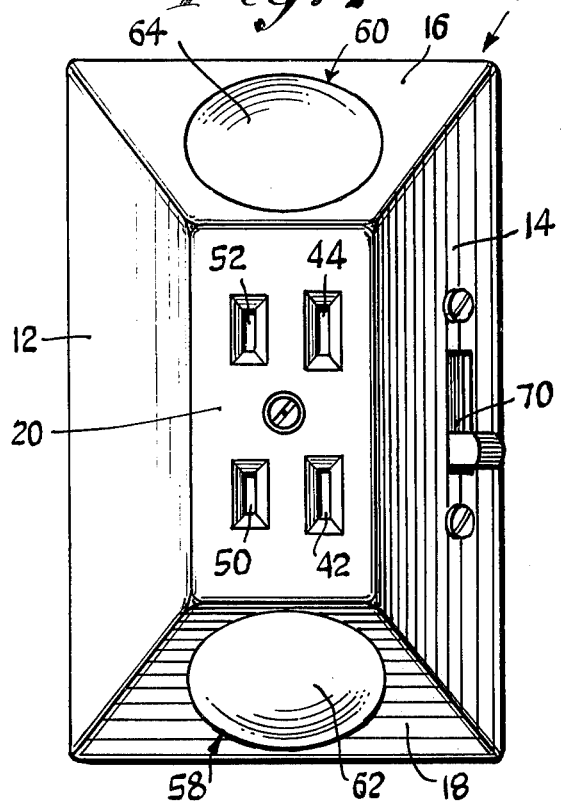
FIG. 1 is a front elevational view of the electrical adaptor and night light of the present invention, comprising a wall plate in the form of a truncated pyramid having a pair of electrical two conductor sockets or outlets on a central plateau portion thereof.
Figure 2:
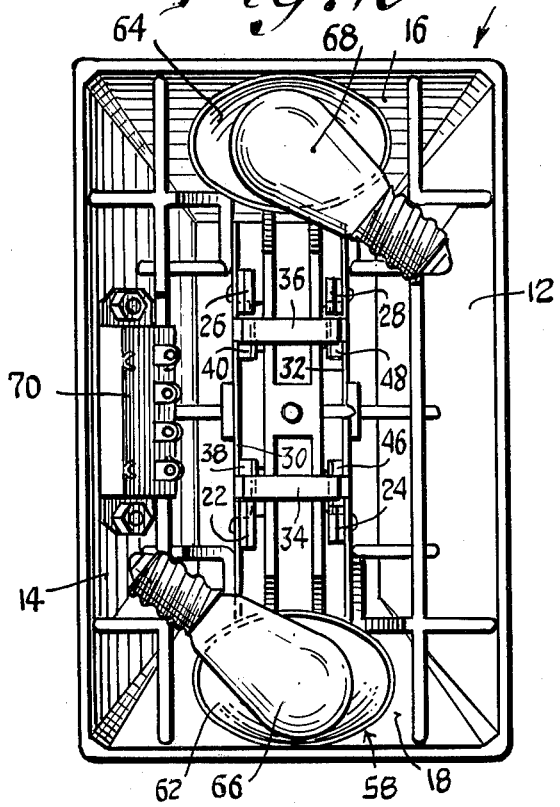
FIG. 2 is a rear elevational view of the electrical adaptor of FIG. 1.
Figure 3:
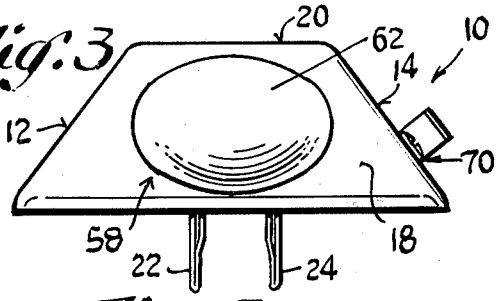
FIG. 3 is a left end elevational view of the adaptor of FIG. 1.
Figure 4:
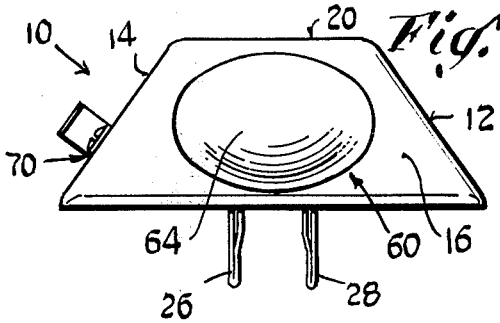
FIG. 4 is right end elevational view of the adaptor.
Figure 5:
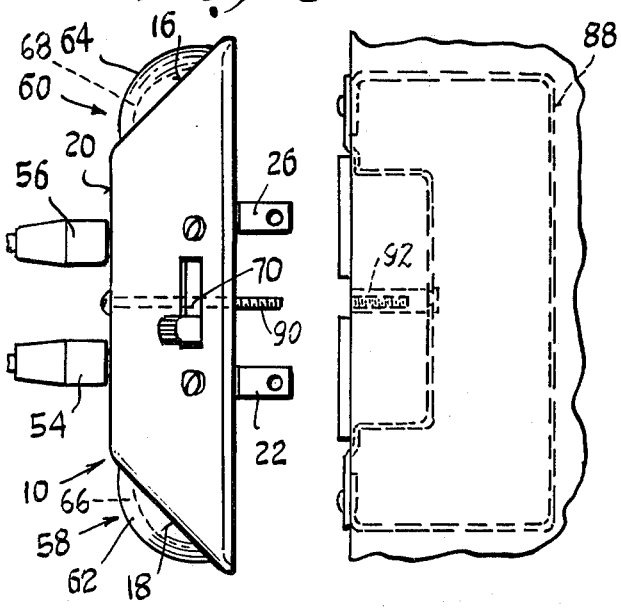
FIG. 5 is a bottom plan view of the adaptor, shown about to be assembled to a typical duplex wall outlet of the type employed in conventional home or office facilities.

Referring to FIGS. 1–5 and in accordance with the present invention there is provided a novel electrical type adaptor and night light providing from a standard duplex wall outlet fixture, subdued illumination and multiple circuits to accommodate a series of electrical plugs. The device includes a wall plate having the configuration of a truncated pyramid, generally designated by the numeral 10. The plate includes four faces 12, 14, 16, 18 and a central plateau 20. Protruding from the rear of the plate are two pairs of prongs 22, 24 and 26, 28 adapted to be inserted in the recesses of a wall outlet. As shown in FIG. 2, the prongs 22, 26 are carried on a conductive mounting strip 30, with the prongs 24, 28 being carried on a similar conductive mounting strip 32. The strips are secured in the wall plate 10 by a pair of upstanding retainer lugs 34, 36 which have undercut surfaces (not shown) engaging spring fingers of the strips 30, 32, and are integral with the wall plate 10. As shown in FIGS. 2, the strip 30 includes two reversely bent portions 38, 40 which are disposed directly below and slightly toward one side of a pair of corresponding recesses 42, 44 in the plateau 20 (FIG. 1) of the wall plate 10. Similarily, the conductive strip 32 includes reversely bent portions 46, 48 which are respectively adjacent holes 50, 52 in the plateau 20. The portions 38, 46 define one socket adapted to receive an electrical plug, with the other portions 40, 48 defining a second socket. These sockets receive electrical plugs 54, 56 respectively as illustrated in FIG. 5.

Disposed on one pair of opposite faces 16, 18 of the housing 10 are windows 58, 60 which are covered by bulbous graticules 62, 64 which are preferably of frosted characteristic so as to provide a soft glow. As shown in FIG. 2, disposed directly beneath the graticules 62, 64 are electric lamps 66, 68 which are secured in place by means of glue, epoxy, or suitable cement. The lamps are connected (through a switch to be described below) to the conductive strips 30, 32 as shown in FIG. 6, but the interconnecting leads have been omitted from FIG. 2 in the interest of clarity.

Provided on the face 14 of the pyramid is a switch 70 of the slide variety, having four contacts 72, 74, 76, 78, (FIG. 6) and a slider 80 adapted to bridge the contacts two at a time. Extending between the contacts 74 and 78 is a diode 82. As shown, the lead or bus 32 extends directly to a common lead of each of the lamps 66, 68. The other leads of these lamps are also connected together and extend to the terminal 76 of switch 70.

Figure 6:
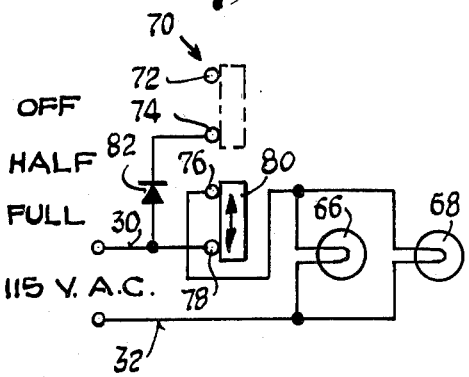
FIG. 6 is a schematic circuit diagram of the electrical adaptor and night light of the present invention, showing a selector switch associated therewith, for controlling the energization of the light.

In operation, with the switch 70 in the position shown in solid lines in FIG. 6, the lamps 66, 68 will receive a full 115 volt a.c. potential and thus provide a normal high-intensity illumination. Actuation of the switch to the position wherein the wiper 80 bridges contacts 74, 76 results in energization of the bulbs 66, 68 through the diodes 82, the latter rectifying the a.c. voltage and resulting in a substantial reduction in the intensity of the lamp illumination. With the switch wiper 80 bridging contacts 72, 74, the lamps 66, 68 will receive no voltage, and will thus not be illuminated. By such an arrangement, two different intensities of light are provided, depending on the position of the wiper 80 of switch 70. In FIG. 6, these positions have been labeled by the designations "off," "half," and "full."

FIG. 5 shows the adaptor and night light of the present invention being inserted in a duplex wall outlet of the type currently employed in typical home or office facilities. The outlet is indicated by the numeral 88. As also shown in FIG. 5, it can be seen that the bulb 66 extends slightly into the plane of the left face 18 of the wall plate 10. Similarily, the bulb 68 extends slightly past the plane defined by the right face 16. The graticules 62, 64 are generally spherical in configuration, and all points thereof are substantially illuminated by the corresponding lamps 66, 68 respectively.

The above arrangement is seen to have a number of distinct advantages. As shown in FIGS. 1 and 5, an extremely neat external appearance is realized by the present construction, in that the wall plate 10 completely overlies and conceals the wall outlet 88. The adaptor maintains the duplex function of the wall outlet by providing two sockets in the central plateau portion 20. There is thus overcome one of the problems with prior night light devices which occupied one of the sockets of a duplex outlet, leaving only a single additional socket available for other appliances, lights, etc. The arrangement of the graticules 62, 64 and switch 70 provide for an extremely compact construction, which is unlikely to be jarred inadvertently or accidentally bumped. The screw 90 can have sufficient length so as to be receivable in the threaded recess 92 of the wall outlet, thereby providing a permanent retention for the adaptor receptacle, and eliminating the possibility of its being jarred or becoming loose. There is thus overcome one of the disadvantages of prior night light constructions involving cube taps and the like.

From the above it can be seen that I have provided a novel combined electrical receptacle type adaptor and night light which is simple in construction, neat in appearance, and especially easy to install and use. The device is thus seen to represent a distinct advance and improvement in the technology of electrical adaptors and night light devices.

Variations and modifications are possible without departing from the spirit of the invention.

I claim:

1. A combined electrical receptacle type adaptor and night light providing, from a standard duplex wall outlet, subdued illumination and multiple circuits to accommodate a series of electrical plugs, comprising in combination:

a. a wall plate having the configuration of a truncated pyramid with four sloping faces and a top plateau portion, said plate being adapted to overlie and to completely conceal the wall outlet, b. a pair of conductor prongs protruding from the rear of the wall plate and adapted to be received in the openings of the wall outlet for establishing electrical contact with the circuits thereof, c. means defining a pair of electrical two-conductor sockets in the top plateau portion of the wall plate, the conductors of each socket being connected respectively to said prongs, d. means on said wall plate defining a pair of windows disposed on two opposite sloping faces thereof, e. a pair of elongate electric lamps carried by the wall plate and disposed respectively at the windows such that light can pass therethrough, said lamps providing illumination on opposite sides of the adaptor, f. a switch carried by the wall plate and connected to one of the prongs and to the lamps so as to control the energization of the latter, said switch being disposed in a third sloping face of said wall plate, g. a diode connected in circuit with the switch such that the diode can be selectively switched in series with the lamps to provide reduced illumination therefrom, and h. a pair of bulbous graticules disposed at said windows respectively and having dispersing light-transmitting characteristics so as to reduce glare from the lamps, and to provide soft illumination, i. said lamps respectively extending outward beyond the plane surface faces of the said two opposite sloping faces of the wall plate, and partially occupying the hollow spaces formed by the bulbous graticules whereby an especially low and compact night light assemblage is realized, without sacrifice of the duplex function of the wall outlet.

2. The invention as defined in claim 1, wherein:

a. said elongate lamps are obliquely positioned mostly within the confines of the four sloping faces of the wall plate.

* * * * *